United States Patent [19]

Thackrey

[11] Patent Number: 4,489,834

[45] Date of Patent: Dec. 25, 1984

[54] COUNTING CAP FOR MEDICINE BOTTLES

[76] Inventor: James D. Thackrey, 13852 Dall La., Santa Ana, Calif. 92705

[21] Appl. No.: 627,219

[22] Filed: Jul. 2, 1984

[51] Int. Cl.[3] ..... B65D 83/04; B65D 85/42

[52] U.S. Cl. ..... 206/534; 215/220; 116/308

[58] Field of Search ..... 116/308; 215/220, 221, 215/218-219; 206/459, 534

[56] References Cited

U.S. PATENT DOCUMENTS

| | | | |
|---|---|---|---|
| 3,151,599 | 10/1964 | Livingston | 116/308 |
| 3,355,067 | 11/1967 | Espinal | 116/308 |
| 3,446,179 | 5/1969 | Bender | 116/308 |
| 3,753,417 | 8/1973 | Garby | 116/308 |
| 3,921,508 | 11/1975 | Fish | 116/308 |
| 3,968,894 | 7/1976 | Herrmann | 215/220 |
| 3,972,436 | 8/1976 | Grau | 215/220 |
| 4,011,829 | 3/1977 | Wachsmann et al. | 116/308 |
| 4,353,473 | 10/1982 | Morris | 215/220 |
| 4,365,722 | 12/1982 | Kramer | 215/220 |
| 4,433,789 | 2/1984 | Gibilisco | 215/220 |
| 4,454,955 | 6/1984 | Kusz et al. | 215/220 |

*Primary Examiner*—Joseph Man-Fu Moy

*Attorney, Agent, or Firm*—James D. Thackrey

[57] ABSTRACT

A medicine bottle and cap, the cap containing a window through which one of several index marks, preferably serial numbers, is visible. The index marks are on a member nesting inside the cap and equipped with spring fingers set at an angle on a skirt. During opening of the bottle, this marked member is prevented from rotating as the cap is unscrewed, thus indexing the index marks. During closing, frictional forces cause all parts to rotate together.

4 Claims, 6 Drawing Figures

COUNTING CAP FOR MEDICINE BOTTLES

BACKGROUND OF THE INVENTION

1. Field of the Invention

The taking of medicine is so regular and so uneventful that many people have difficulty a short time later remembering whether they have, or have not, taken a particular dose. This problem has been recognized for some time, and a variety of mechanical arrangements have been proposed to allow the patient to check, so as to be relieved of worry or to prevent under medication or over medication. The present invention is in the field of devices which display a serial index mark, advancing it each time the bottle is opened.

2. Description of Prior Art

A considerable number of pill-timing schemes have been used to solve the problem of reminding a patient to take a dose of medicine or reminding him he has already taken that dose. The most used ones involve some scheme of compartmentalization of the necessary medication, such that the pills are placed in compartments labeled as to day, to dose number or time of day, or serially numbered. These devices are reasonably satisfactory if a responsible person is available and has the time and patience to fill the compartments properly. These conditions, responsibility, availability, and time are the main drawback to the usual pill-timing devices. Some of them will, however, dispense several pills or pills of several types.

In dispensing pills of a single type, a number of window-containing bottle caps have been invented. Through the window a moveable element marked with index is visible. In only a few devices does the indicating element index in position relative to the window each time the cap is loosened, removed, replaced, and re-tightened. Thus, by looking at the index mark displayed through the window, one can see where in the repetitive sequence of doses one is. The majority of window caps do not have positive stops as they are indexed manually, enabling the user to index two numbers at once. Further, the caps which do index depend on the direction of rotating force on the cap, rather than using positive stops on the bottle as in my invention.

Some existing devices have posts or spindles which penetrate the pill container, at least theoretically allowing liquids or foreign matter to contaminate the pill supply.

SUMMARY OF THE INVENTION

The present invention requires a multiple-start thread on the bottle, with positive stop surfaces integral with the thread. One stop surface is at the cap end of the thread. This surface stops rotary motion of an inwardly-projecting lug on the external member of the cap. The other stop surface is positioned so as to stop rotation of the cap only after it has moved more than the space between thread-starts. The number of thread-starts corresponds to the number of daily doses, or is seven if one dose per day is to be taken.

An indicator element nests within the outer cap. The indicator element has a flat top, on which the desired indicia are typically marked. On its periphery is a short cylindrical shell, with the skirt of this shell formed into flexible helical finger-springs. The number of finger springs is normally but not necessarily equal to the number of thread starts. Inside the indicator element is a combination seal and spring disc such as is conventional in the common child-proof cap.

In operation, the indicator element follows the motion of the outer cap by friction between them, except when the outer cap is being unscrewed. Then the tip of the finger springs abuts the stop surface at the thread-start when the outer cap is still engaged with the thread on the bottle. Further rotation of the outer cap in the unscrewing direction overcomes friction, and indexes the indicator element to a new position within the cap.

The object of this invention is to provide a simpler, cheaper version of counting cap. Being a throwaway item, medicine bottles must be cheap else they will not be used. The overall object is to make available a reminder type counting cap so forgetful people, and those responsible for them, can more easily keep track of medicine doses and be assured the proper dose is being administered.

BRIEF DESCRIPTION OF THE DRAWINGS

FIGS. 2 and 6 show the bottle closed, FIG. 3 half-open, FIG. 4 fully openable, FIG. 5 half-closed. The view in these figures is a partial view of the essential elements only.

DETAILED DESCRIPTION

Figure 1:
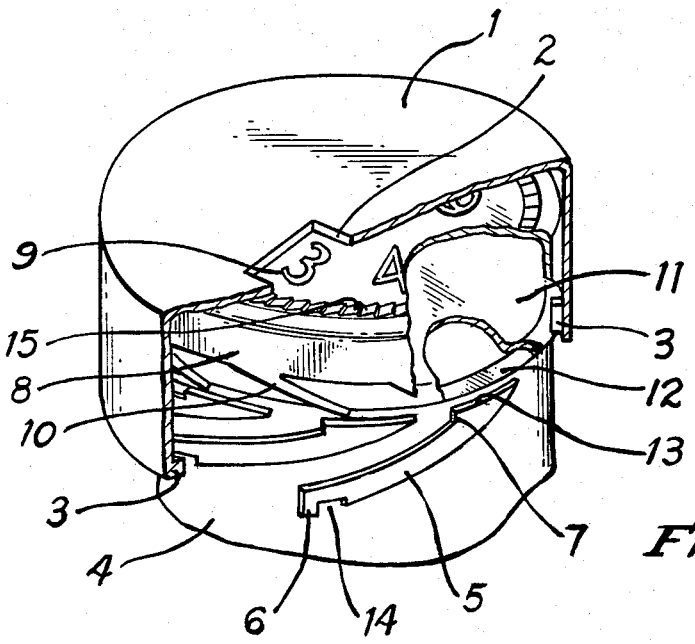
FIG. 1 is a perspective view of the invention in the preferred embodiment.

The mechanical features of the invention are all shown in FIG. 1. Two major parts are shown, the cap and the bottle or container. The cap is made up in part of outer cap 1 having a window, 2 and a number of lugs, 3 on its skirt corresponding to one lug per thread start of threads Item 5.

The bottle 4 is generally cylindrical at its upper end where the cap engages it. A number of threads 5 are on the outer periphery of the cylindrical portion. The threads are multiple-start threads. Each has a first abutment surface 6 and a second abutment surface 7. As shown in FIG. 1, if desired a childproofing notch 14 can be incorporated adjacent to first abutment surface 6 to require the user to push as well as turn to initiate the opening of the assembly.

Item 8 indicator element carries index marks 9 positioned so as to be visible through the window, and spring fingers 10 which are part of, or attached to, the skirt of Item 8. The spring fingers 10 have a length, angle of placement, and flexibility such that their ends ride in a flexed condition on a non-helical portion 13 of threads 5 as the cap is turned in the direction of removal (normally counterclockwise viewed from the cap end). When the spring fingers reach the thread start the opening which receives lugs 3—their flexing relaxes and the end moves so as to engage second abutment surface 7, preventing farther rotary motion of Item 8 and indexing index marks 9 in window 2.

Item 11 is a conventional combination seal and disc spring. It is of a relaxed height greater than the space the closed cap allows between the end of the bottle, Item 12, and a region near the center of Item 8. Consequently Item 11 exerts sealing force at the bottle end 12, reacted against indicator element Item 8 and outer cap 1. Being of one piece of material, it keeps the contents of the bottle sealed and clean.

Figure 2:
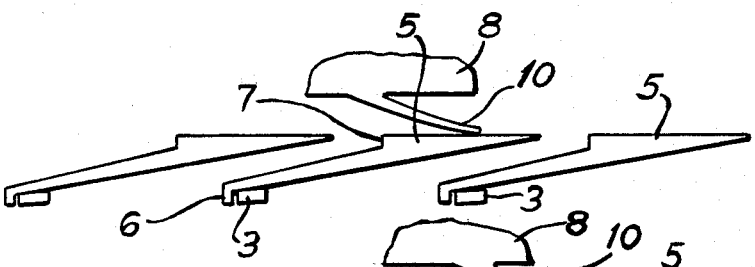
FIGS. 2 through 6 show an "unwrapped" view of the actions by which counting or indexing is accomplished.

FIGS. 2 through 5 show the successive steps in opening and closing. In FIG. 2 the end of spring finger 10 is shown near the midpoint of the flat (non-helical) portion 13 of thread 5. Obviously the end can be anywhere on the flat portion. As long as it lies between adjacent abutment surfaces 7, there will be lost rotary motion until the spring finger engages abutment surface 7 followed by indexing motion until the cap with its lugs 3 rotates through the motion allowed to it by abutment surfaces 6 and 7 and engages abutment surface 7. In the preferred embodiment the latter—the indexing motion between indicator element 8 and outer cap 1—equals the rotary distance between thread starts which equals the spacing of lugs 3. The provision for lost motion is to allow some failure of friction to cause indicator element 8 to keep in registration with outer cap 1 during closing of the cap. As shown in FIGS. 2–6 for illustrative purposes, the lost motion is about half the motion. This does not prevent the relative motion between outer cap and indicator element from indexing (i.e., advancing the serial indication seen through the window in the cap), it merely affects the number of index marks 9 needed on indicator element 8 and the number of open-close cycles to return to the initial index mark. The index marks are preferably serial indications such as 1,2,3, etc.

Figure 3:
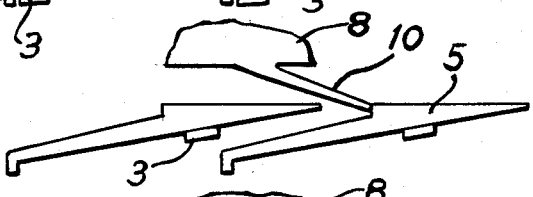
Figure 4:
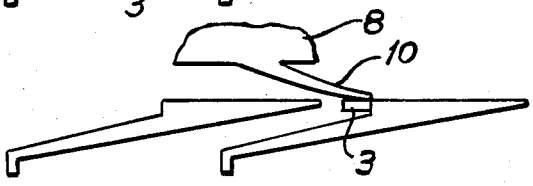
Figure 5:
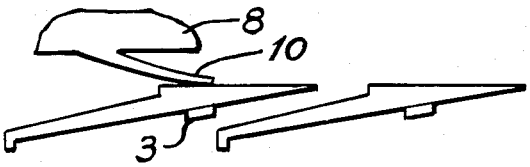
Figure 6:
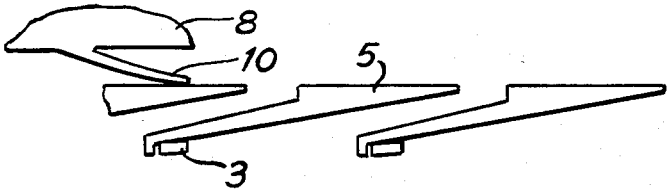

In FIGS. 2 through 6 the parts are shown as they would be if unwrapped from a bottle; that is they are shown flat rather than curved into and out of the paper. FIGS. 2, 3, and 4 show the opening cycle starting with the bottle fully closed in FIG. 2. The cap can be removed and replaced freely when parts are as shown in FIG. 4. FIGS. 4, 5, and 6 show the positions of the parts while the bottle is being closed. No allowance for frictional slip is incorporated in FIGS. 5 and 6.

In some embodiments with some materials of construction it may be necessary or desirable to have a more positive control of the motion so as to reduce dependence on friction. This is the purpose of ratchet member strip 15 in FIG. 1. It is preferably constructed as shown, with sloping teeth to resist motion in one direction more than in the other. Such a strip may obviously be put on the top or side surface of indicator element 8, on the inner surfaces of outer cap 1, or both.

Applicant visualizes the number of thread starts necessary for a pharmacy to stock being 3 and 4 for 3 or 4 doses per day, and 7 for a week of daily doses. These should be sufficient to cover the needs of all forgetful users. The principle and apparatus can be applied to a wide variety of numbers-per-cycle merely by changing the number of thread-starts or the lost motion.

The invention having been described in its preferred embodiment, it is clear that modifications are within the ability of those skilled in the art without exercise of the inventive faculty. Accordingly the scope of the invention is defined in the scope of the following claims.

I claim:

1. A container for medicinal tablets, the cap of which contains a window through which a serial indicator is visible, the serial indicator advancing each time the container is opened and closed, the open end of the container and the cap being generally cylindrical and being attached to each other by multiple-start threads on the container which are engaged by lugs on the cap, and having a disc-spring member inside the cap, held down by the cap and sealing to the rim of the container opening, wherein the improvement comprises:

first and second abutment surfaces on the threads, said first abutment surfaces limiting rotation of the cap in the engaging direction by abutting the lugs on the cap, and said second abutment surfaces similarly limiting rotation of the cap in the disengaging direction, the rotation motion allowed to the cap being greater than the spacing between thread starts, and an indicator element on which a number of serial indications are marked, the number being the number of thread starts, said indicator element being located within the cap, extending under the window and having a skirt which passes outside the disc-spring member and inside the cap, and a number of finger-springs fixed to the skirt of said indicator element, said finger springs extending from the skirt both toward the container and circumferentially in the direction of disengagement, having on the end a shape which will engage said second abutment means, and being of a circumferential length, angle of placement, and flexibility that said finger-springs may be carried by friction between the cap and said indicator element along with the cap when the cap is rotated in an engaging direction, whereby the cap and indicator element will move together when the cap is rotated to engage the container, and said finger-springs will abut said second abutment surface overcoming friction and causing rotation between the cap and indicator element when the cap is rotated in the disengaging direction, this rotation indexing said indicator element and advancing the serial indication each time the container is opened.

2. Apparatus as described in claim 1, further comprising:

a notch on the threads adjacent said first abutment surface of sufficient width to receive the lugs on the cap rendering the cap childproof.

3. Apparatus as described in claim 2, further comprising:

a ratchet member strip on said indicator element to increase friction between said indicator element and the cap during closing of the container.

4. Apparatus as described in claim 1, further comprising:

a ratchet member strip on said indicator element to increase friction between said indicator element and the cap during closing of the container.

* * * * *